US006592157B1

(12) United States Patent
Spurr

(10) Patent No.: US 6,592,157 B1
(45) Date of Patent: Jul. 15, 2003

(54) LATCH

(75) Inventor: Nigel Victor Spurr, Birmingham (GB)

(73) Assignee: Meritor Light Vehicle Systems (UK) Limited, Birmingham (GB)

( * ) Notice: Subject to any disclaimer, the term of this patent is extended or adjusted under 35 U.S.C. 154(b) by 26 days.

(21) Appl. No.: 09/654,234

(22) Filed: Sep. 2, 2000

(30) Foreign Application Priority Data

Sep. 4, 1999 (GB) ..... 9920869

(51) Int. Cl.[7] ..... E05C 3/06
(52) U.S. Cl. ..... 292/216; 292/201
(58) Field of Search ..... 292/216, 201, 292/336.3, DIG. 23; 70/264

(56) References Cited

U.S. PATENT DOCUMENTS 3,858,919 A * 1/1975 Keefeldt ..... 292/216
4,097,077 A * 6/1978 Gahrs ..... 292/216
5,427,421 A * 6/1995 Hamaguchi ..... 292/216
5,803,515 A * 9/1998 Arabia ..... 292/216
6,050,620 A * 4/2000 Rogers ..... 292/216

* cited by examiner

*Primary Examiner*—Gary Estremsky
(74) *Attorney, Agent, or Firm*—Carlson, Gaskey & Olds

(57) ABSTRACT

An entry door lock system includes an energy storage device (27) to permit unlatching if unlatching movement of a door handle occurs before the latch has been unlocked. The device (27) is passive if unlocking occurs before unlatching movement of the door handle. The invention avoids the need for repeat movement of the door handle in cases where unlocking follows initial door handle movement.

20 Claims, 4 Drawing Sheets

LATCH

This application claims priority to Great Britain Patent Application No. 9920869B, filed on Sep. 4, 1999.

BACKGROUND OF THE INVENTION

This invention relates to a latch for doors and the like, and particularly to a door latch of a vehicle.

Known passive entry type car door lock systems work by the driver having about his person a radio frequency card which, as he approaches his own vehicle, is recognized by the vehicle and the vehicle then unlocks itself. On certain passive entry systems the recognition process only starts when an outside door handle is initially moved by the driver. Under such circumstances the electrical power actuator which unlocks the door does so in a fraction of a second and before the door handle has been fully lifted, thus allowing the opening of the door.

However, if the door handle is lifted quickly it can beat the unlocking actuator leaving the door locked with the handle in the up position. The driver must release the handle and then lift it again to open the door, and this can be frustrating to some drivers.

One known solution to this problem is to provide an actuator which both unlocks and also unlatches a door latch. However, significantly more power is required to unlatch than to unlock thus requiring a bigger actuator.

SUMMARY OF THE INVENTION

According to the invention there is provided a latch comprising a housing, a locking member of the housing movable between locked and unlocked conditions, a latch release member of the housing movable between closed and open conditions and a latching member of the housing movable between latched and unlatched conditions, movement of the latch release member to the open condition causing movement of the latching member to the unlatched condition when the locking member is in the unlocked condition, and movement of the latching member to the unlatched condition being prevented when the locking member is in the locked condition, wherein an energy storage device is provided between the latch release member and said latching member, and a blocking member of the housing is movable from a disengaged condition to an engaged condition in which movement of said latching member to the unlatched condition is prevented when the locking member is in the locked condition, movement of the latch release member to the open condition causing said energy storage means to bias said latching member to the watched condition when said blocking member is in the engaged condition, movement of said blocking device to the disengaged condition permitting movement of said latching member to the unlatched condition under the action of said bias.

The present invention overcomes the prior art problems by storing energy in e.g. an unlatching spring. If the driver opens the door handle quickly, the spring energy is used to unlatch after the power actuators have unlocked the door. If the driver opens the door handle slowly then the spring is not required to store or release energy.

Preferably the locking member, latching member, latch release member and blocking member are pivotally mounted on said housing. In the preferred embodiment, the blocking member is movable in the opposite sense to the locking member. The latching member and latch release member may be pivoted about the same axis. The energy storage device may be a tension spring.

The locking member may include a force transmission element insertable between the latching member and the latch releasing member in order to transmit motion therebetween in the unlocked condition.

BRIEF DESCRIPTION OF THE DRAWINGS

Other features will be apparent from the following description of a preferred embodiment shown by way of example only in the accompanying drawings, in which.

DETAILED DESCRIPTION OF THE PREFERRED EMBODIMENT

Figure 1:
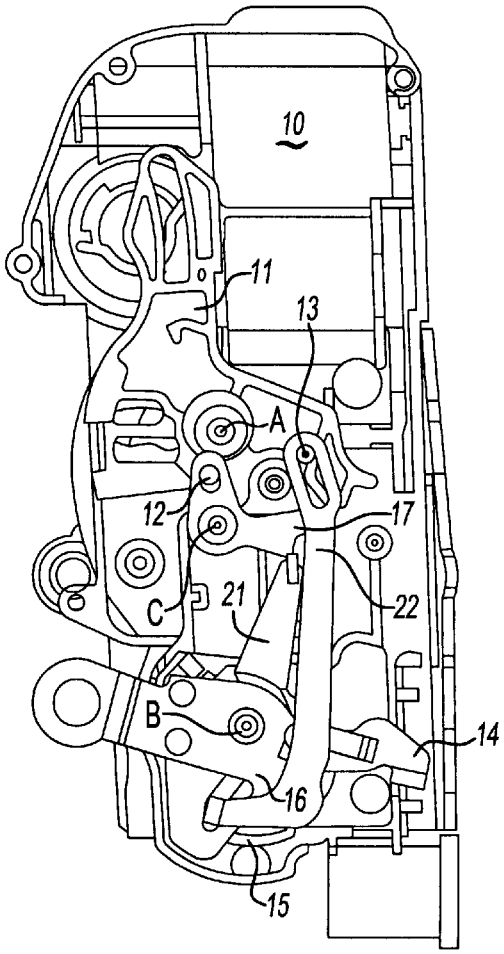
FIG. 1 shows in plan a vehicle door latch mechanism according to the present invention, and in the unlocked and latched condition.

Numerous parts are illustrated in the drawings accompanying this specification, however only those parts necessary for understanding the present invention are explained in detail.

Figure 8:
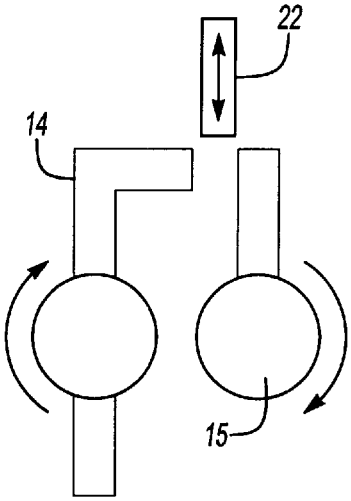
Fig-8 PRIOR ART
FIG. 8 is a schematic representation of a prior art mechanism.
Figure 9:
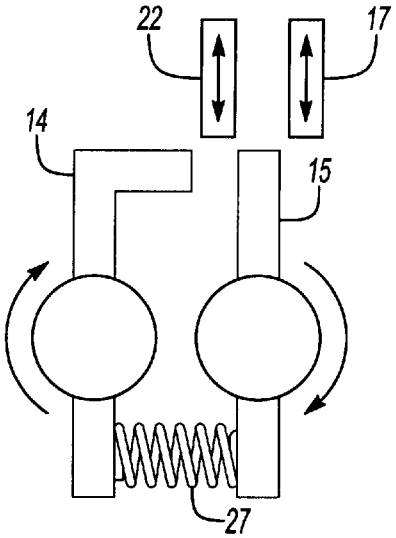
FIG. 9 is a schematic representation of a mechanism according to the invention.

The invention is illustrated schematically with reference to FIGS. 8 and 9.

The known arrangement of FIG. 8 includes a pivotable release lever 14, and a pivotable cam lifter 15. A locking link 22 is insertable between the lever 14 and lifter 15. When the link 22 is inserted, the lever 14 can transmit motion to the lifter 15 to release the door latch. When the link is withdrawn, the arcuate range of movement of the lever is insufficient to move the lifter; accordingly in this condition the latch cannot be released by the lever 14.

FIG. 9 illustrates the invention. A blocking device 17 is movable to prevent releasing movement of the lifter 15. The lever 14 and lifter 15 are however linked by a spring 27. In this configuration, the lever 14 is still unable to actuate the lifter when in the locked condition (link 22 withdrawn). However the lifter is placed underload via the spring 27 such that if the blocking device is withdrawn, the lifter will rotate to watch the door.

Thus a repeat motion of the door release lever to permit insertion of the locking link 22 is not necessary.

With reference to FIGS. 1–7, a preferred embodiment of a door latch mechanism comprises a housing 10 having a locking lever 11 pivotable therein about an axis A extending perpendicularly to the plane of the drawing. The lever is pivotable, typically under the action of an electrical actuator, and has upright pegs 12,13 for attachment to other parts of the mechanism, to be described below.

A release lever 14 is pivotable about an axis B extending perpendicularly to the plane of the drawing. Also pivotable about axis B are a pawl lifter 15 and an outside handle lever 16. The levers 14,16 and pawl lifter 15 are engageable in various ways for movement together, as will become apparent.

A pawl lifter blocking lever 17 is pivotable about a third axis C, parallel to axes A and B, and has two arms 18,19. The first arm 18 is slotted and is engaged with peg 12 such that anti-clockwise movement of locking lever 11 results in clockwise movement of blocking lever 17, and vice-versa. The second arm 19 constitutes a blocking member movable into and out of engagement with a blocking arm 21 of the pawl lifter 15.

A locking link 22 is slotted at one end 23 to engage the upright peg 13, and has a depending leg 24 insertable between the release lever 14 and pawl lifter 15 in order to transmit movement therebetween.

Figure 5:
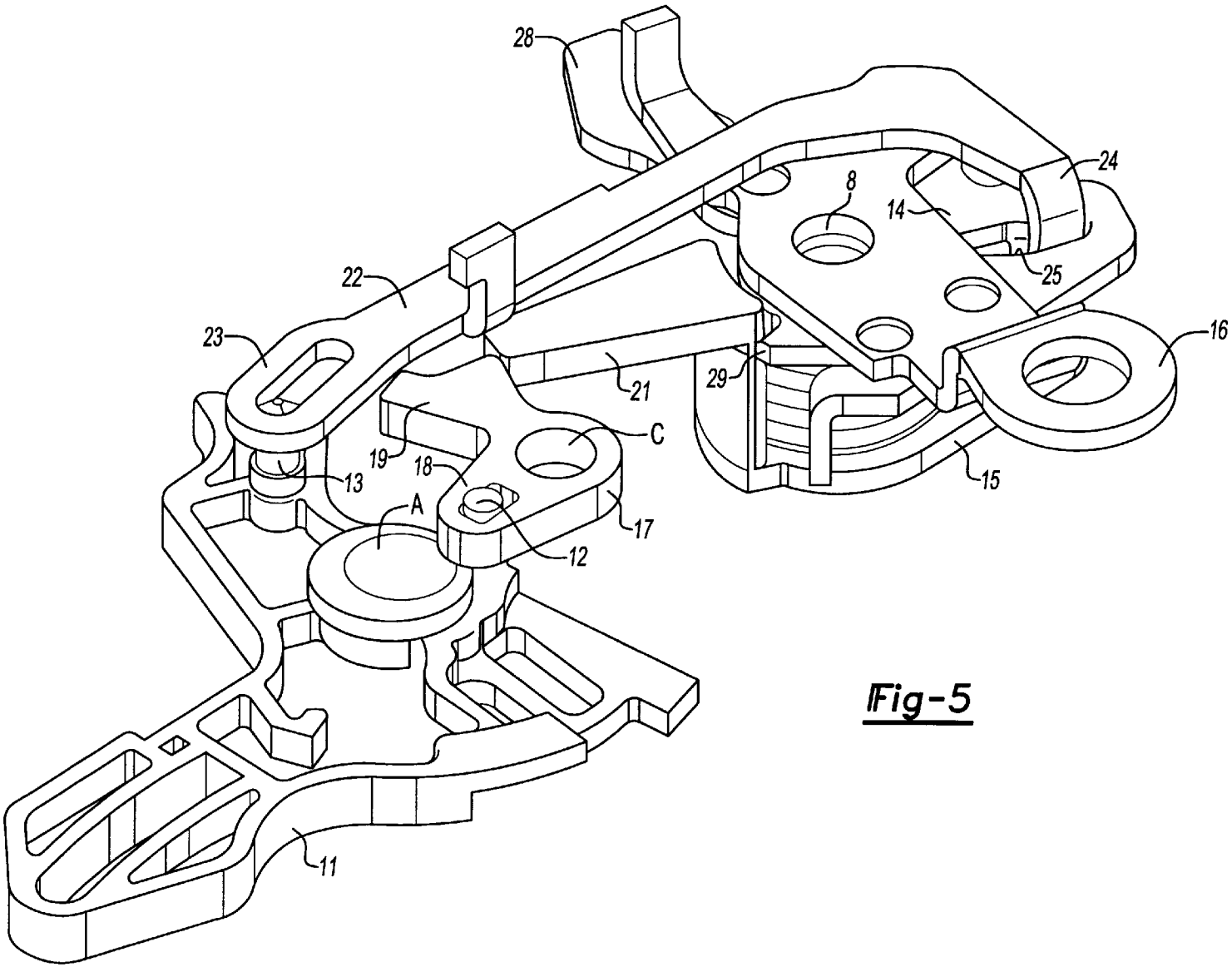
FIG. 5 is an enlarged perspective view of the latch components comprising the invention.
Figure 6:
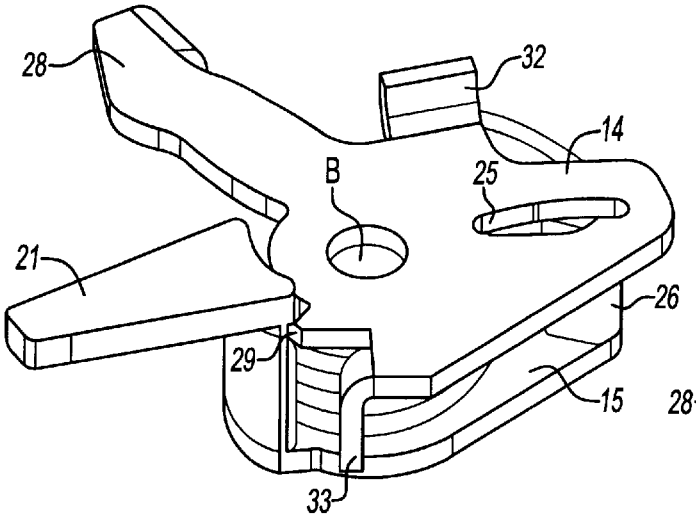
FIG. 6 is an enlarged perspective view of the pawl lifter and release arm of the invention
Figure 7:
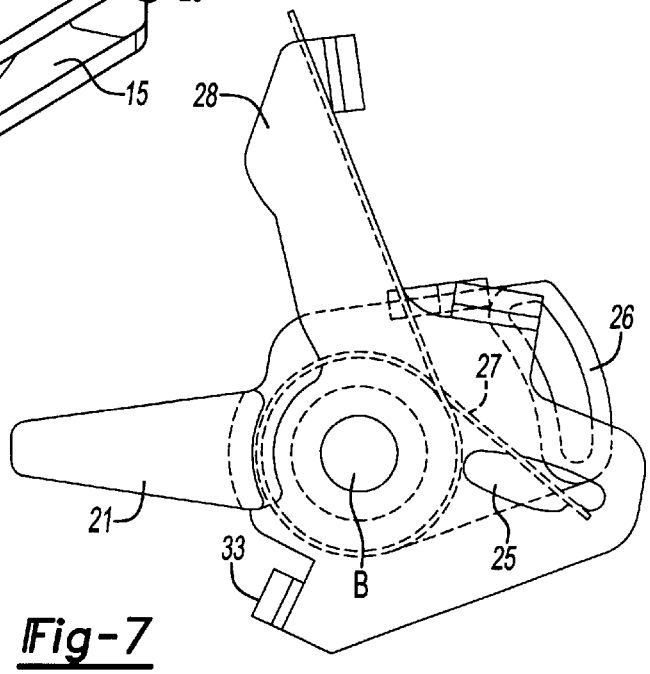
FIG. 7 is a plan view of the components illustrated in FIG. 6.

As illustrated in FIG. 5, the leg 24 passes through a slot 25 of the release lever, and is engageable with an upstanding abutment 26 of the pawl lifter 15 (FIG. 6).

A hairpin spring 27 located about axis B has free ends bearing on a release lever arm 28 and the pawl lifter abutment 26, thereby to urge the release lever arm 28 and pawl lifter blocking arm 21 apart (FIG. 6).

A release lever abutment 29 is engageable with the pawl lifter blocking arm 21 to restrict clockwise movement of the release lever relative to the pawl lifter.

In order to return the release lever 14 to the unlatched condition of FIG. 1, a second hairpin spring (not shown) acts about axis B between the housing 10 and a return arm 33 of the release arm.

In use arcuate movement of the pawl lifter 15 disengages the door latch in order to permit the vehicle door to be opened. The release lever arm 28 of the release lever is in use connected to an internal door handle, and an external release am 32 of the pawl lifter 15 is in use engageable with the external door handle lever 16. Different release arms ensure independent movement, in a known manner.

Operation of the latch mechanism is as follows:

FIG. 1 shows the door latch in the unlocked condition. The blocking lever 17 is pivoted anti-clockwise out of possible engagement with the pawl lifter blocking arm 21. The peg 13 is clockwise to the maximum extent and the locking link is urged downwards (as viewed), for example by a light spring (not shown). In this condition the leg 24 is between the release lever 14 and the pawl lifter abutment 26; accordingly anti-clockwise movement of the release lever 14 is transmitted directly to the pawl lifter 15, which also moves anti-clockwise since the blocking arm 21 is unobstructed. Thus the door latch is released, and the components assume the configuration illustrated in FIG. 4.

It will be noted that the bottom part of the release lever slot 25 (as viewed) is narrowed somewhat so that the leg 24 is a relatively tight fit; this reduces lost motion in the mechanism.

Figure 2:
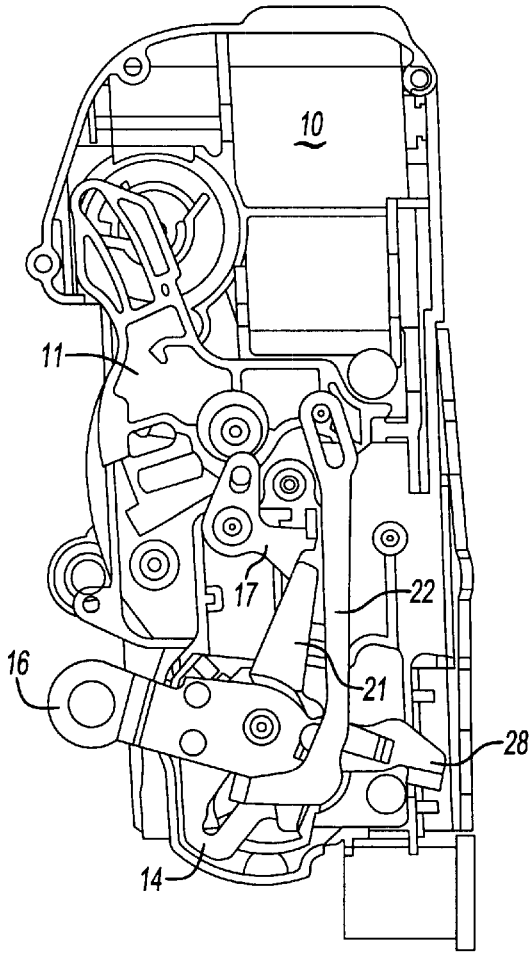
FIG. 2 shows the mechanism of FIG. 1 in the locked and latched condition.
Figure 3:
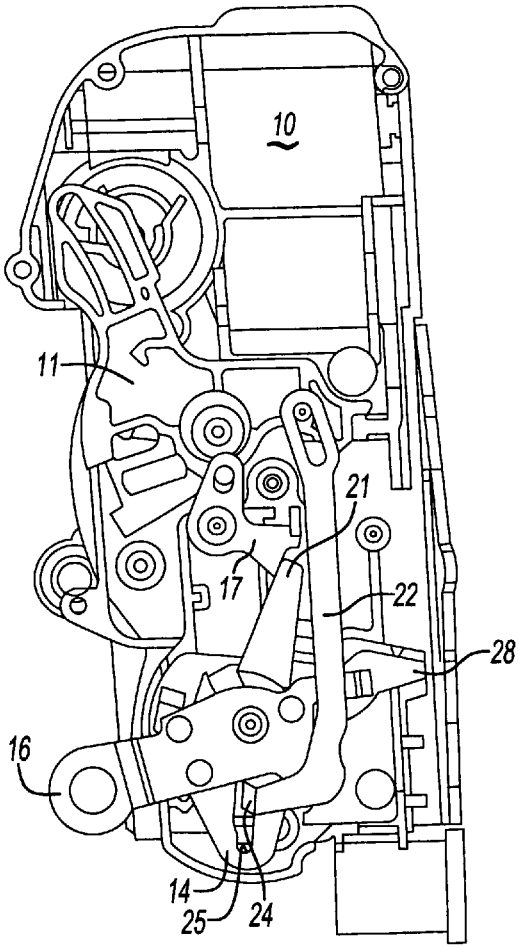
FIG. 3 shows the mechanism of FIG. 1 in the locked condition with unlatching attempted.
Figure 4:
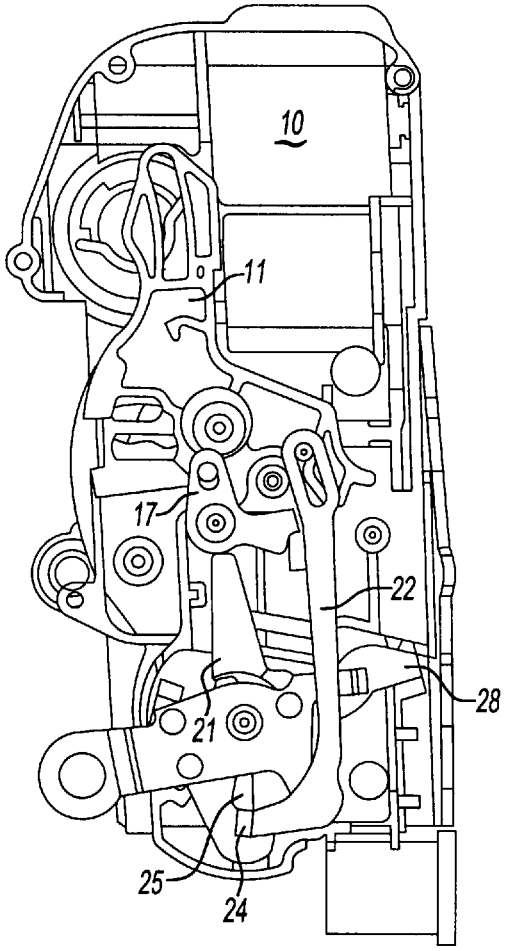
FIG. 4 shows the mechanism of FIG. 3 in the unlocked condition and with unlatching completed.

FIG. 2 shows the latch mechanism in the locked condition. The locking lever 11 is pivoted anti-clockwise, thus pivoting the blocking lever 17 clockwise so as to obstruct anti-clockwise movement of the blocking arm 21. The locking link 22 is lifted out of engagement with the abutment 26, and accordingly direct mechanical actuation of the pawl lifter 15 by the release lever 14 is not possible.

If in this condition the release lever 14 is pivoted, the hairpin spring 27 is stressed, and urges the pawl lifter 15 anti-clockwise; movement is however prevented by the blocking lever 17 and the door cannot be unlatched. This condition occurs in use when the door handle is moved to the open condition, but the lock actuator has not been energised, or has not been energised sufficiently in advance.

If however the lock actuator is energised whilst the door handle is in the open condition, he locking lever pivots clockwise, thus releasing engagement of the blocking lever 17 and blocking arm 21. As a consequence, the pawl lifter rotates anti-clockwise under the action of the hairpin spring 27, and the door is unlatched.

Downwards movement of the locking link 22 is prevented by the abutment 26 until pivoting of the pawl lifter 15 has occurred. However the slot in the upper end of the locking link 22 permits the necessary pivoting of the locking lever 11 and peg 13, and eventually the link 22 is permitted to move down as the pawl lifter pivots to the latch released condition illustrated in FIG. 4.

The invention thus provides an economical and uncomplicated means of overcoming the problem of rapid door handle movement. Furthermore the invention can readily be applied to existing mechanism if required. In the preferred embodiment, the additional components required are hairpin spring 27 and associated spring reaction members, and blocking lever 17.

What is claimed is:

1. A latch comprising a housing, a locking member of the housing movable between locked and unlocked conditions, a latch release member of the housing movable between closed and open conditions and a latching member of the housing movable between latched and unlatched conditions, movement of the latch release member to the open condition causing movement of the latching member to the unlatched condition when the locking member is in the unlocked condition, and movement of the latching member to the unlatched condition being prevented when the locking member is in the locked condition, wherein an energy storage device is provided between the latch release member and said latching member, and a blocking member of the housing is movable from a disengaged condition to an engaged condition in which movement of said latching member to the unlatched condition is prevented when the locking member is in the locked condition, movement of the latch release member to the open condition causing said energy storage means to bias said latching member to the unlatched condition when said blocking member is in the engaged condition, movement of said blocking device to the disengaged condition permitting movement of said latching member to the unlatched condition under the action of said bias, wherein the latch includes an unlocking power actuator.

2. A latch according to claim 1 wherein said latching member and latch release member are pivotable with respect to the housing.

3. A latch according to claim 1 wherein said locking member is pivotable with respect to said housing.

4. A latch according to claim 3 wherein said blocking member is pivotable with respect to said housing in the opposite sense to said locking member.

5. A latch according to claim 1 wherein said blocking member is pivotable with respect to said housing.

6. A latch according to claim 1 wherein said energy storage means comprises a coil spring.

7. A latch according to claim 1 and further including a force transmission element insertable between the latching member and latch releasing member in order to transmit motion therebetween.

8. A latch according to claim 1 in which the blocking member is moveable by said locking member from the disengaged condition to the engaged condition.

9. A latch comprising a housing, a locking member of the housing movable between locked and unlocked conditions, a latch release member of the housing movable between closed and open conditions and a latching member of the housing movable between latched and unlatched conditions, movement of the latch release member to the open condition causing movement of the latching member to the unlatched condition when the locking member is in the unlocked condition, and movement of the latching member to the unlatched condition being prevented when the locking member is in the locked condition, wherein an energy storage device is provided between the latch release member and said latching member, and a blocking member of the housing is movable from a disengaged condition to an engaged condition in which movement of said latching member to the unlatched condition is prevented when the locking member is in the locked condition, movement of the latch release member to the open condition causing said energy storage means to bias said latching member to the unlatched condition when said blocking member is in the engaged condition, movement of said blocking device to the disengaged condition permitting movement of said latching member to the unlatched condition under the action of said bias, wherein said energy storage means comprises a coil spring, and wherein said spring is a hairpin spring.

10. A latch according to claim 9 wherein said hairpin spring is located about said common axis.

11. A latch comprising a housing, a locking member of the housing movable between locked and unlocked conditions, a latch release member of the housing movable between closed and open conditions and a latching member of the housing movable between latched and unlatched conditions, movement of the latch release member to the open condition causing movement of the latching member to the unlatched condition when the locking member is in the unlocked condition, and movement of the latching member to the unlatched condition being prevented when the locking member is in the locked condition, wherein an energy storage device is provided between the latch release member and said latching member, and a blocking member of the housing is movable from a disengaged condition to an engaged condition in which movement of said latching member to the unlatched condition is prevented when the locking member is in the locked condition, movement of the latch release member to the open condition causing said energy storage means to bias said latching member to the unlatched condition when said blocking member is in the engaged condition, movement of said blocking device to the disengaged condition permitting movement of said latching member to the unlatched condition under the action of said bias, wherein said latching member and latch release member are pivotable with respect to the housing, and wherein said latching member and latch release member are pivotable about a common axis.

12. A latch according to claim 11 wherein said locking member is pivotable with respect to said housing.

13. A latch according to claim 12 wherein said blocking member is pivotable with respect to said housing.

14. A latch according to claim 12 wherein said blocking member is pivotable with respect to said housing in the opposite sense to said locking member.

15. A latch according to claim 12 wherein said energy storage means comprises a coil spring.

16. A latch according to claim 15 wherein said spring is a hairpin spring.

17. A latch according to claim 16 wherein said hairpin spring is located about said common axis.

18. A latch according to claim 17 and further including a force transmission element insertable between the latching member and latch releasing member in order to transmit motion therebetween.

19. A latch according claim 18 in which the latch includes an unlocking power actuator.

20. A latch according to claim 19 in which the blocking member is moveable by said locking member from the disengaged condition to the engaged condition.

* * * * *